US006947569B2

(12) United States Patent
Yamada et al.

(10) Patent No.: US 6,947,569 B2
(45) Date of Patent: Sep. 20, 2005

(54) AUDIO SIGNAL PROCESSING DEVICE, INTERFACE CIRCUIT DEVICE FOR ANGULAR VELOCITY SENSOR AND SIGNAL PROCESSING DEVICE

(75) Inventors: Yuji Yamada, Tokyo (JP); Hirofumi Kurisu, Kanagawa (JP)

(73) Assignee: Sony Corporation, Tokyo (JP)

( * ) Notice: Subject to any disclaimer, the term of this patent is extended or adjusted under 35 U.S.C. 154(b) by 826 days.

(21) Appl. No.: 09/911,686

(22) Filed: Jul. 24, 2001

(65) Prior Publication Data

US 2002/0025054 A1 Feb. 28, 2002

(51) Int. Cl.[7] ..... H04R 5/02
(52) U.S. Cl. ..... 381/310; 381/74; 381/17
(58) Field of Search ..... 381/74, 309, 310, 381/1, 300, 98, 17

(56) References Cited

U.S. PATENT DOCUMENTS 5,696,831 A * 12/1997 Inanaga et al. ..... 381/309
6,243,476 B1 * 6/2001 Gardner ..... 381/303

* cited by examiner

*Primary Examiner*—Brian T. Pendleton
(74) *Attorney, Agent, or Firm*—Jay H. Maioli

(57) ABSTRACT

An audio signal processing device to enable accurate calculation of angles and displacements and to enable reduction of circuit scales includes a digital signal processing circuit (31) that performs virtual acoustic image localization processing such that an acoustic image is localized at an arbitrary position in the vicinity of the listener by reproducing, using headphones (2) or a plurality of speakers, output signals obtained by signal processing input audio signals, and is characterized in that analog detection signals from a sensor (1) that detects the state of action of the listener are input to the digital signal processing circuit (31) via an A/D converter (30), and the transmission characteristics of these audio signals are modified in realtime, according to values derived by processing the values of analog detection signals from the sensor (1) or by processing the analog detection signals.

30 Claims, 7 Drawing Sheets

AUDIO SIGNAL PROCESSING DEVICE, INTERFACE CIRCUIT DEVICE FOR ANGULAR VELOCITY SENSOR AND SIGNAL PROCESSING DEVICE

BACKGROUND OF THE INVENTION

1. Field of the Invention

This invention concerns an audio signal processing device which performs virtual acoustic image localization processing, an angular velocity sensor interface device, and a signal processing device.

2. Description of the Related Art

In recent years, numerous audio and image reproduction devices have been proposed which use a motion sensor to perform virtual acoustic image localization processing. For example, out-of-head virtual-acoustic image localization headphones have been proposed in which the angle of rotation of the listener's head is detected, and signal processing is performed to localize, outside the head, the virtual acoustic image of an audio signal corresponding to angle data detected by digital signal processing.

Below, FIG. 6 through FIG. 10 are used to explain such a conventional audio signal processing device which performs signal processing in order to localize, outside the head, the virtual audio image of an audio signal corresponding to angle data. FIG. 6 is a block diagram of an audio signal processing device having a rotation angle detection function, designed so as to localize the virtual audio image such that the position of localization of the reproduced acoustic image when the audio signals are reproduced by headphones is the same as that for two reproducing speakers, placed before the listener.

In FIG. 6, when the headphones 2, having left and right speakers 2L and 2R and on which is mounted an angular velocity sensor 1 to detect rotation angles, undergo rotational motion due to rotation of the head of the listener, the angular velocity sensor 1 outputs an analog detection signal with voltage proportional to the angular velocity. This detection signal from the angular velocity sensor 1 passes through a band-limiting filter 3 which removes unnecessary high-frequency components, and is supplied to an A/D converter 4 which converts analog signals into digital signals.

Digital detection signals, obtained on the output side of the A/D converter 4 by digitizing analog detection signals, are supplied to the microprocessor 5. In this microprocessor 5, these digital detection signals for the angular velocity are integrated and processed to obtain angle data. In this microprocessor 5, the rotation angle for actual localization of the acoustic image is calculated from this angle data, and corresponding signal processing data is supplied to the signal processing circuit 6.

On the other hand, audio signals from the sound source, supplied to the audio signal input terminals 7 and 8, pass through the A/D converters 9 and 10 respectively for conversion from analog signals into digital signals, and are supplied to the digital signal processing circuit 6.

In this digital signal processing circuit 6, audio processing is performed in order to localize, outside the head, the virtual acoustic image of the necessary audio signals corresponding to the angle data calculated by the microprocessor 5, and the resulting right and left audio signals are supplied to D/A converters 11R and 11L, which convert digital signals into analog signals.

The right and left audio signals resulting when analog signals are converted by the D/A converters 11R and 11L pass through the power amplifiers 12R and 12L respectively, and are supplied to the right and left speakers 2R and 2L of the headphones 2, so as to apply signals which localize an optimal virtual acoustic image outside the head of the listener listening to the output. The angular velocity sensor 1 is mounted on the headphones 2, so as to detect rotations of the listener's head.

FIG. 8 shows this digital signal processing circuit 6, divided into the part the characteristics of which change according to movements of the listener and the part the characteristics of which do not change. In FIGS. 8, 7*a* and 8*a* denote input terminals to which are supplied, respectively, digitized audio signals from the audio input terminals 7 and 8; the digital audio signals supplied to this input terminal 7*a* pass through the digital filter 13 and are supplied to the adder 17, and audio signals supplied to this input terminal 7*a* pass through the digital filter 14 and are supplied to the adder 18.

Further, digital audio signals supplied to the input terminal 8*a* pass through the digital filter 15 and are supplied to the adder 17, and digital audio signals supplied to this input terminal 8*a* pass through the digital filter 16 and are supplied to the adder 18. In this case, the digital filters 13, 14, 15 and 16 comprise, for example, FIR filters.

In the drawing of the principle of acoustic image localization shown in FIG. 7, the digital filters 13, 14, 15 and 16 respectively realize transfer functions HRR, HRL, HLR, and HLL from the speakers SL and SR to both the ears, for the case in which the listener M is facing in a fixed direction (for example, the forward direction, that is, the direction facing the midpoint between the speakers SL and SR).

The outputs from the digital filter 13 and digital filter 15 are added by the adder 17, and this addition signal is supplied to the time-difference application circuit 19; the outputs from the digital filter 14 and digital filter 16 are added by the adder 18, and this addition signal is supplied to the time-difference application circuit 20. The output signals from these time-difference application circuits 19 and 20 pass through the level-difference application circuits 21 and 22, and are supplied to the D/A converters 11R and 11L, respectively.

Here, changes in the transfer function resulting from movements of the listener's head are effected through control signals which focus on time differences and level differences in the signals reaching both ears, supplied to the control terminals 19*a* and 20*a* of the time-difference application circuits 19 and 20 respectively and to the control terminals 21*a* and 22*a* of the level-difference application circuits 21 and 22 respectively. In this way signals are simplified; for example, when the listener's head is facing the forward direction and rotates in the right direction, signals reaching the left ear arrive earlier, compared with the original state, and signals reaching the right ear arrive later, compared with the original state.

Moreover, the left ear approaches the sound source (the speakers SL and SR), and the right ear recedes from the sound source, so that the level of signals reaching the left ear is high compared with the original state, and the level of signals reaching the right ear is low compared with the original state. Hence by using a microprocessor 5 to control only this change with respect to a reference position, a dynamic transfer function can be simulated.

The delay time applied by the left-side time-difference application circuit 20 is represented by the characteristic curve Tb, shown as a dash line in the delay time characteristics of FIG. 9; the delay time applied by the right-side time-difference application circuit 19 is represented by the characteristic curve Ta, shown as a long and dash line in the delay time characteristics of FIG. 9.

The characteristic curves Ta and Tb are curves having completely opposite directions of increase and decrease with respect to the direction of rotation of the head of the listener M. As a result, even when headphones are used, time differences from the sound source to both ears are applied to the headphone reproduction signals similar to the sound differences when listening to sound from a sound source placed within a 180° range in the forward direction while turning the head right and left.

The level difference applied by the left-side level-difference application circuit 22 is represented by the characteristic curve La, shown as a long and dash line in the relative level characteristics of FIG. 10; the level difference applied by the right-side level-difference application circuit 21 is represented by the characteristic curve Lb, shown as a dash line in the relative level characteristics of FIG. 10. This FIG. 10 shows levels relative to the state in which the head rotation position is 0° (the forward direction).

The characteristic curves La and Lb are curves having completely opposite directions of increase and decrease with respect to the direction of rotation of the head of the listener M. That is, in the level-difference application circuit 22 the level changes of the characteristic curve La are applied, and in the level-difference application circuit 21 the level changes of the characteristic curve Lb are applied, so that sound volume changes similar to the case of listening to an actual sound source in the forward direction are applied to the headphone reproduction signals as well.

The above explanation has described a method of localizing an acoustic image before the listener M; by reversing the directions of change of the characteristic selected by the direction of rotation, however, an acoustic image can also be localized behind the listener M. Further, processing can also be performed for an arbitrary number of channels for a plurality of sound sources.

Hence it is possible to localize high-quality virtual acoustic images both before and behind the listener M.

However, the rotation angle interface used in the above-described configuration requires that a band-limiting filter 3, A/D converter 4, offset-removal filter, and other additional circuits be added externally to the microprocessor 5; moreover, it is necessary to send the angle data to the digital signal processing circuit 6 which performs signal processing using the calculated angle data.

Also, as described above, when an A/D converter is provided separately, and rotation angles are detected, scattering and fluctuations (temperature drift and similar) in DC offsets characteristic to the sensor, amplifier, and A/D converter occur, and consequently problems arise such as the inability to calculate accurate angles and displacements, and the occurrence of overflow in the interface unit due to a DC offset.

Further, in the above configuration, the circuit scale is large and the mounting area is considerable, and there is the additional problem of high cost. Also, sensor detection and signal processing using detection values are performed by separate devices, specifically, by the microprocessor 5 and the digital signal processing circuit 6, so that communication processing between them is necessary.

SUMMARY OF THE INVENTION

In light of these problems, one object of this invention is to enable calculation of accurate angles and displacements, while also reducing the circuit scale.

Hence one object of this invention is to provide an audio signal processing device which performs virtual acoustic image localization processing such that an acoustic image is localized at an arbitrary position in the vicinity of the listener, by reproducing, by means of headphones or a plurality of speakers, output signals resulting from signal processing of input audio signals and comprises digital signal processing means which performs virtual acoustic image localization processing of the input audio signals, an A/D converter which converts into digital signals the analog detection signals from a sensor which detects the state of motion of the listener and control means which performs control so as to change in realtime the transmission characteristics of the digital signal processing means, according to output signals from the A/D converter, and at least part of the A/D converter is comprised within the digital signal processing means.

By means of this invention, sensor detection signals are acquired by the digital signal processing circuit simultaneously with the input audio signals, so that signal processing of the sensor detection signals and signal processing of these audio signals can be performed within the same device, specifically, within the digital signal processing device, and communication between hardware components is rendered unnecessary.

The sensor interface can be realized using signal processing software, offsets can be removed by processing within the digital signal processing circuit, there are no errors due to scattering in the characteristics of devices, and there is no need for large capacitors or other external components.

Another object of this invention is to provide an interface device for a sensor, which supplies analog detection signals from the sensor as digital detection signals and comprises an A/D converter which converts said analog detection signals into digital signals, computation means which converts said A/D converter output signals into detection data in a prescribed unit system and memory which stores detection data computed by the computation means. The detection data stored in the memory can be read by external equipment and at least part of the A/D converter, the computation means and the memory are comprised within digital signal processing means which performs signal processing of and outputs input audio signals.

By means of this invention, detection signals input as angular velocity data are converted into angle data and can be acquired externally, so that external processing (for example, image processing) can be performed simultaneously with, and in synchronization with, audio processing, and the external equipment can be used to simplify the angular velocity sensor interface device and angle conversion processing.

Still another object of this invention is to provide an audio signal processing device which, by reproducing, by means of headphones or a plurality of speakers, output signals resulting from signal processing of input audio signals, performs virtual acoustic image localization processing such that an acoustic image is localized at an arbitrary position in the vicinity of the listener, and an image display device which reproduces images before either one eye or both eyes of the listener. The audio signal processing device comprises digital signal processing means which performs virtual acoustic image localization processing of the input audio signals, an A/D converter which converts into digital signals the analog detection signals from a sensor which detects the state of motion of the listener, and control means which performs control so as to change and output in realtime the transmission characteristics of the digital signal processing means, according to output signals from the A/D converter, and which performs control so as to update the display content or display position in the image display device and at least part of the A/D converter is comprised within the digital signal processing means.

By means of this invention, when the display content in an image display device provided before one eye or both eyes of the listener is changed according to movements of the listener, the interface for this can be provided by interface processing for the sensor mounted on the audio signal processing device, and images and audio can be changed simultaneously using a simple configuration.

DESCRIPTION OF THE PREFERRED EMBODIMENTS

Figure 1:
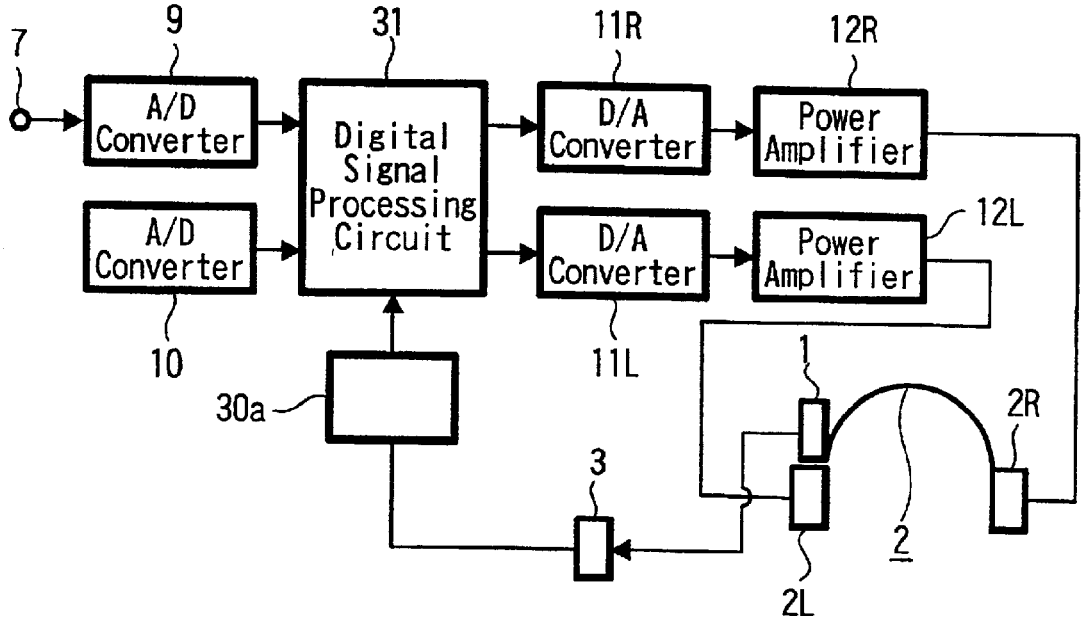
FIG. 1 is a block diagram showing an example of an embodiment of the audio signal processing device of this invention.
Figure 2:
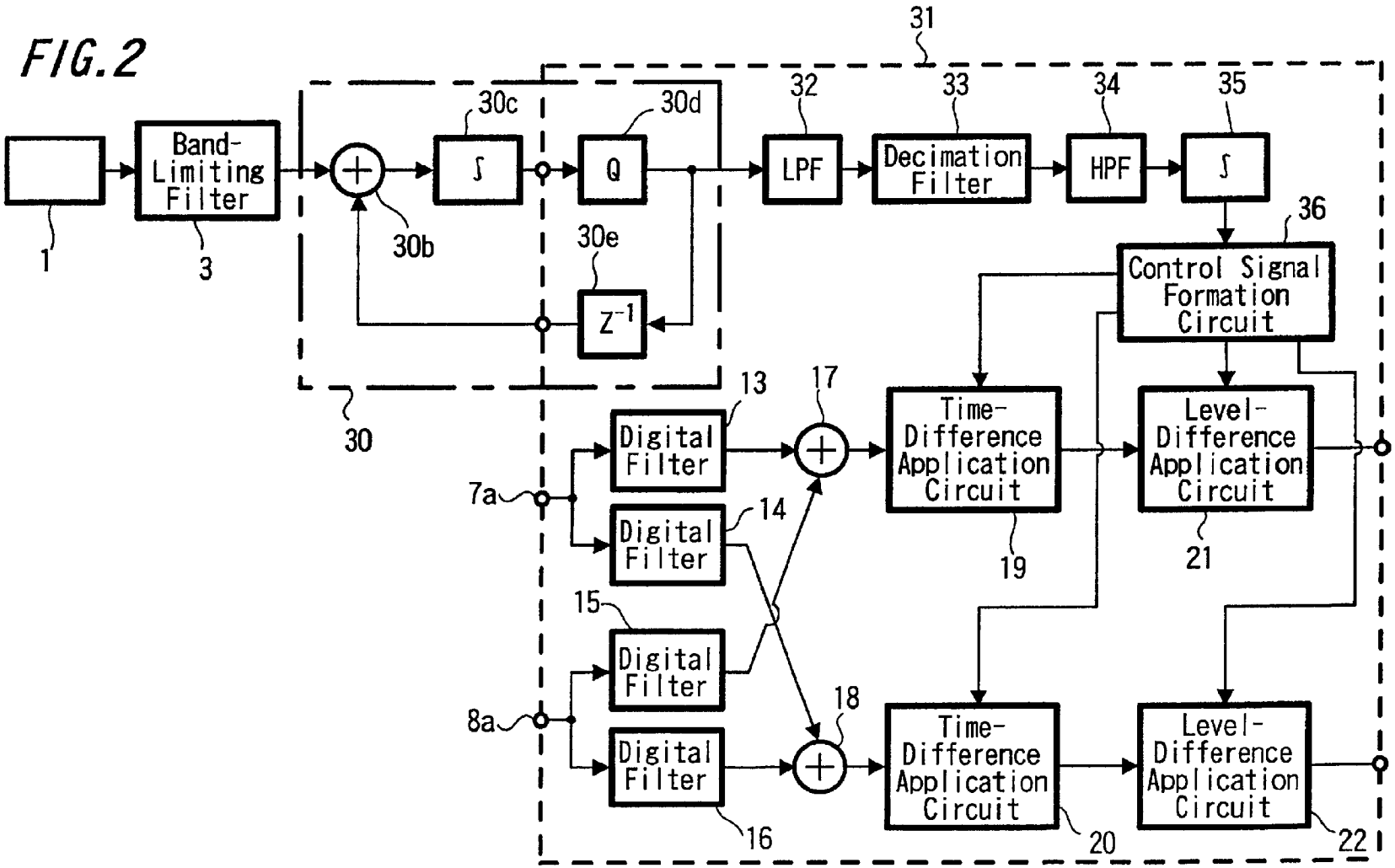
FIG. 2 is a functional block diagram showing an example of the digital signal processing circuit of the example of FIG. 1.
Figure 6:
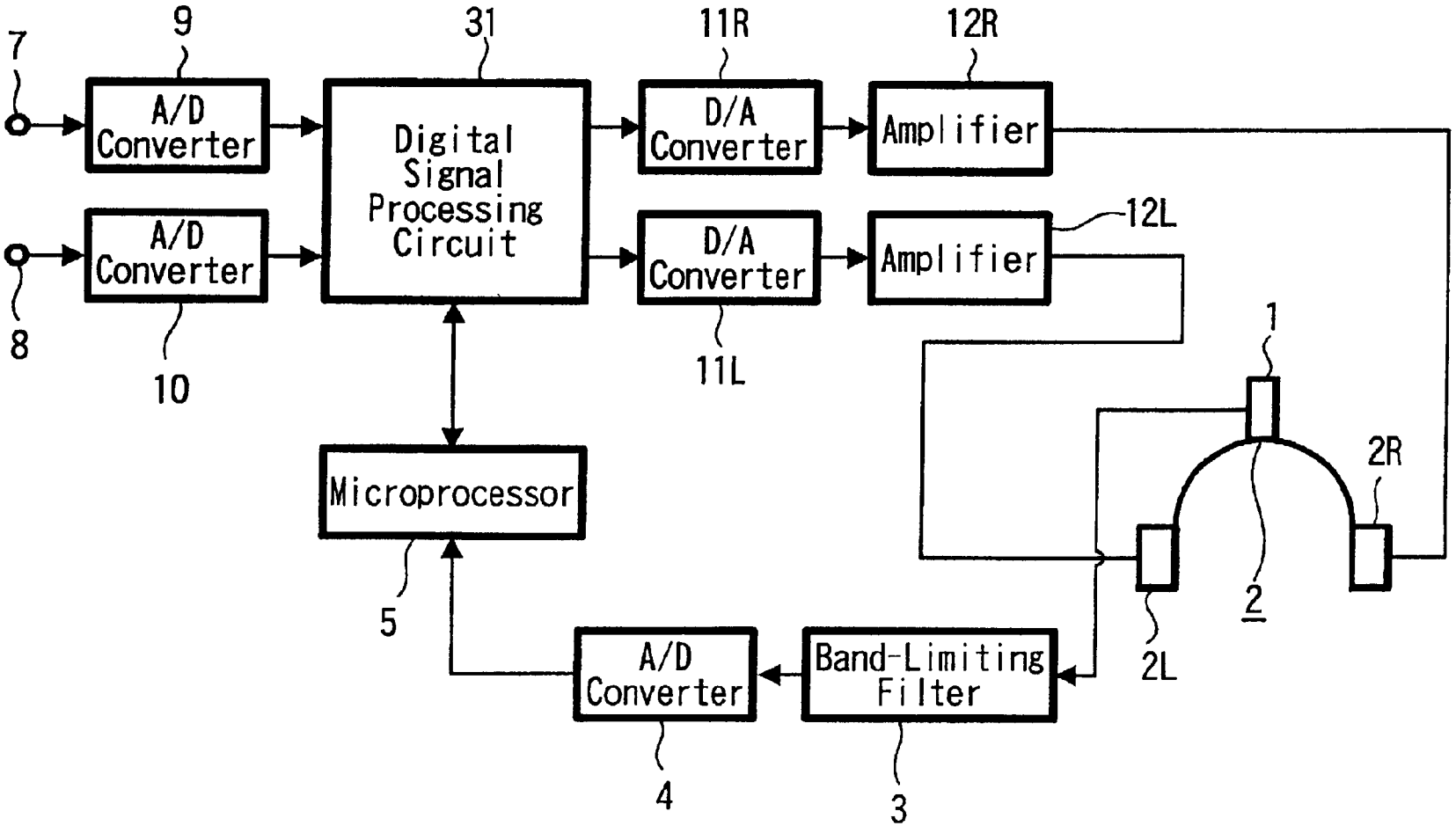
FIG. 6 is a schematic diagram showing an example of a conventional audio signal processing device.
Figure 8:
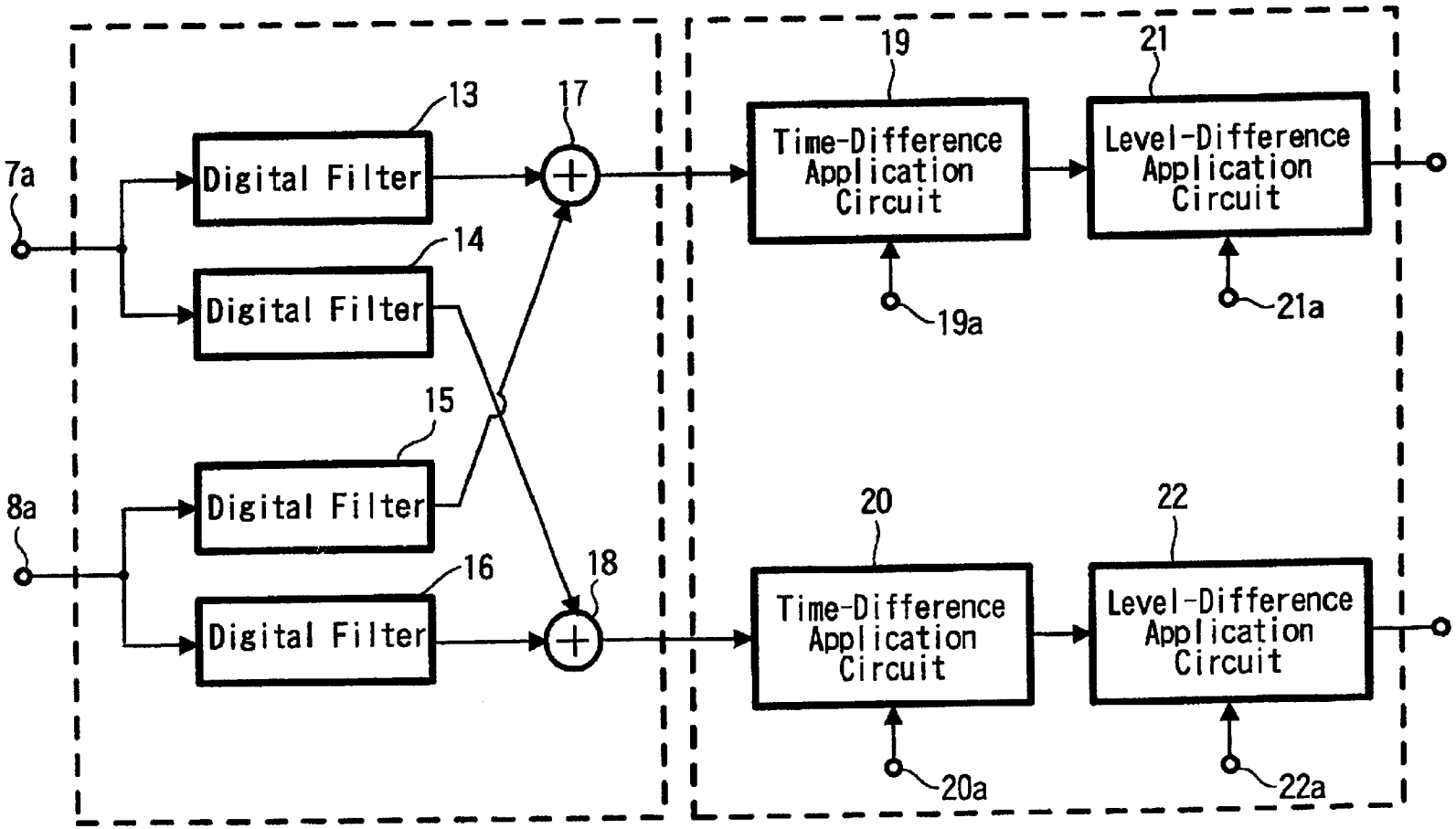
FIG. 8 is a functional block diagram showing an example of a conventional digital signal processing circuit.

Below, examples of embodiments of the audio signal processing device, angular velocity sensor interface device, and signal processing device of this invention are explained, referring to FIG. 1 and FIG. 2. In FIG. 1 and FIG. 2, parts which correspond to parts in FIG. 6 and FIG. 8 are assigned the same symbols.

The example of FIG. 1 is an audio signal processing device which, in listening to audio signals using headphones, localizes the reproduced audio image in the same position as the audio image localization position when two speakers, placed in front of the listener, are broadcasting.

In the example of FIG. 1, when the headphones 2, having left and right speakers 2L and 2R and on which is mounted an angular velocity sensor 1 which detects rotation angular velocity, undergo rotating motion, for example due to rotation of the head of the listener, this angular velocity sensor 1 outputs an analog detection signal with voltage proportional to the angular velocity.

As this angular velocity sensor 1, for example, a well-known piezoelectric vibratory gyroscope may be used. This piezoelectric vibratory gyroscope can detect rotation angular velocity reliably with a simple configuration; and this piezoelectric vibratory gyroscope can be made small and lightweight, and can be designed to further reduce power consumption.

Detection signals from the angular velocity sensor are passed through a band-limiting filter 3 to remove unnecessary high-frequency components, and through a part 30*a* of a one-bit A/D converter 30 constituting an interface, and are supplied to the digital signal processing circuit 31.

On the other hand, audio signals from a sound source as supplied to audio signal input terminals 7 and 8 of, for example, 2 channels are supplied respectively to this digital signal processing circuit 31 via A/D converters 9 and 10 that convert analog signals into digital signals.

In this digital signal processing circuit 31, necessary audio signals corresponding to angle data, as described below, are subjected to signal processing in order to localize an acoustic image outside the head, and the resulting right and left audio signals are supplied to D/A converters 11R and 11L which convert digital signals into analog signals.

The right and left audio signals converted into analog signals by these D/A converters 11R and 11L pass through power amplifiers 12R and 12L respectively, and are supplied to the right and left speakers 2R and 2L of the headphones 2, so as to apply audio signals which localize an out-of-head virtual acoustic image optimally for the listener who is listening.

In this example, the digital signal processing circuit 31 is configured as shown by the functional block diagram of FIG. 2. In FIGS. 2, 7*a* and 8*a* are the input terminals to which are supplied digitized audio signals from the audio signal input terminals 7 and 8, respectively.

Figure 9:
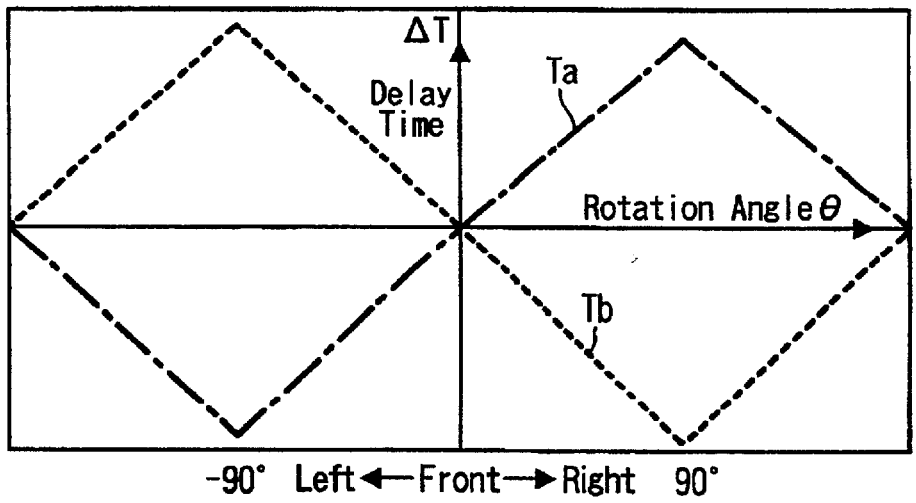
FIG. 9 is a diagram used in the explanation of this invention.

Similarly to FIG. 9, the digital audio signals supplied to this input terminal 7*a* pass through a digital filter 13 consisting of, for example, an FIR filter, and are supplied to the adder 17, and in addition, the digital audio signals supplied to this input terminal 7*a* pass through a digital filter 14 consisting of, for example, an FIR filter, and are supplied to the adder 18.

Also, the digital audio signals supplied to this input terminal 8*a* pass through a digital filter 15 consisting of, for example, an FIR filter, and are supplied to the adder 17, and in addition, the digital audio signals supplied to this input terminal 8*a* pass through a digital filter 16 consisting of, for example, an FIR filter, and are supplied to the adder 18.

Figure 7:
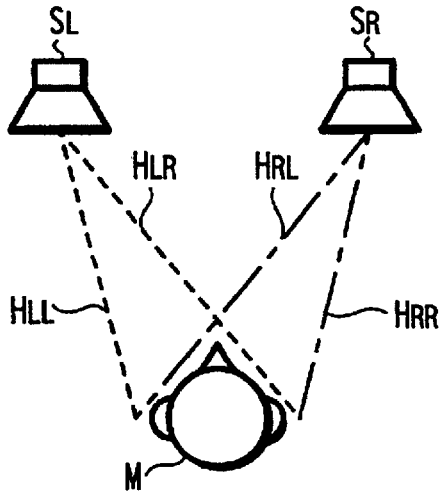
FIG. 7 is a schematic diagram used to explain the principle of acoustic image localization.

The digital filters 13, 14, 15 and 16 respectively realize transfer functions HRR, HRL, HLR, and HLL from the speakers SL and SR in the drawing of the principle of acoustic image localization shown in FIG. 7 to both the ears, for the case in which the listener M is facing in a fixed direction (for example, the forward direction). Through convolution of the audio signals supplied to the input terminals 7*a*, 8*a* and their transfer functions, and reproduction at the ears of the listener, an acoustic image can be localized at the positions of the speakers SL and SR.

The outputs from the digital filter 13 and digital filter 15 are added by the adder 17, and this addition signal is supplied to the time-difference application circuit 19; the outputs from the digital filter 14 and digital filter 16 are added by the adder 18, and this addition signal is supplied to the time-difference application circuit 20. The output signals from these time-difference application circuits 19 and 20 pass through the level-difference application circuits 21 and 22, and are supplied to the D/A converters 11R and 11L, respectively.

In this example, analog detection signals from the angular velocity sensor 1 are passed through a band-limiting filter 3 to remove unnecessary high-frequency components, and are supplied to an adder 30*b* consisting of a one-bit ΔΣ-type A/D converter, which is the one-bit A/D converter 30. This one-bit ΔΣ-type A/D converter 30 passes output signals from the adder 30*b* through an integrator 30*c* and supplies the signals to a quantizer 30*d* configured within the digital signal processing circuit 31; output signals from this quantizer 30*d* pass through the one-sample delay element 30*e* and are supplied to the adder 30*b*.

In this case, detection signals from the angular velocity sensor 1 are acquired by the same one-bit A/D converter 30 within the digital signal processing circuit 31 used for audio signal processing, so that data can be input from the one-bit port of the digital signal processing circuit 31, and a high-precision angular velocity sensor interface with simple configuration can be realized.

A low-pass filter 32 is used to limit the frequency band of the output signals from this one-bit A/D converter 30, and the signals are supplied to a decimation filter 33 which converts the sampling rate. In this decimation filter 33, the sampling frequency is downsampled from, for example, 48 kHz to 1 kHz.

Output signals from this decimation filter 33 are passed through a high-pass filter 34 to remove the ultra-low frequency component, that is, the offset and the drift, and are supplied to the integrator 35; using this integrator 35, angle data is obtained. The angle data obtained from this integrator 35 is supplied to the control signal formation circuit 36, consisting of an angle calculator and memory.

This control signal formation circuit 36 forms control signals to supply time differences and level differences in the signals reaching both ears, to simulate changes in transfer functions due to movement of the listener's head.

Control signals formed by this control signal formation circuit 36 are supplied to the time-difference application circuits 19 and 20, and to the level-difference application circuits 21 and 22. For example, when the listener's head rotates to the right, signals arriving at the left ear arrive earlier than in the original state, and signals arriving at the right ear arrive later than in the original state.

Because the left ear approaches the sound source (the speakers SL and SR), and the right ear recedes from the sound source, the level of signals reaching the left ear is higher than in the original state, and the level of signals reaching the right ear is lower than in the original state. Hence by controlling only the change due to motion with respect to a reference position using these control signals, a dynamic transfer function can be simulated.

The delay time applied by the left-side time difference application circuit 20 is represented by the characteristic curve Tb, shown as a dash line in the delay time characteristics of FIG. 9; the delay time applied by the right-side time difference application circuit 19 is represented by the characteristic curve Ta, shown as a long and dash line in the delay time characteristics of FIG. 9.

The characteristic curves Ta and Tb are curves having completely opposite directions of increase and decrease with respect to the direction of rotation of the head of the listener M. As a result, even when headphones are used, time differences from the sound source to both ears are applied to the headphone reproduction signals similar to the sound differences when listening to sound from a sound source placed within a 180° range in the forward direction while turning the head right and left.

Figure 10:
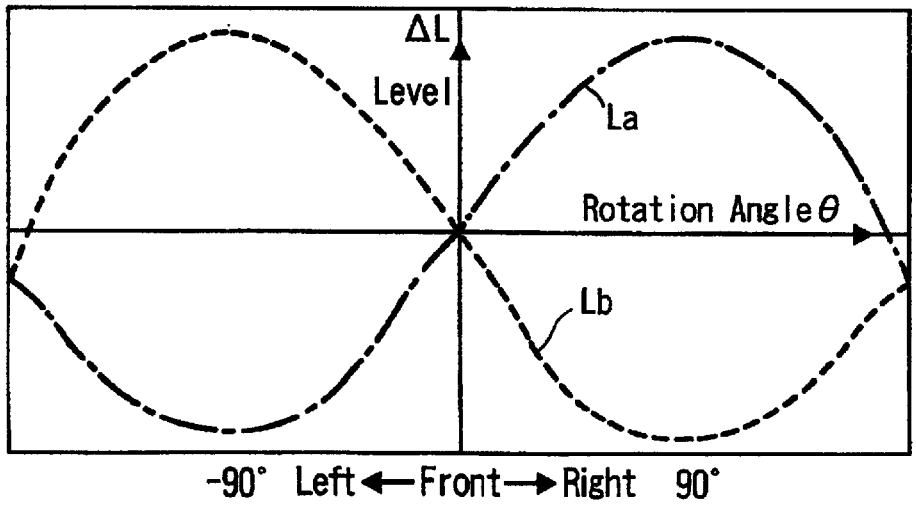
FIG. 10 is a diagram used in the explanation of this invention.

The level difference applied by the left-side level-difference application circuit 22 is represented by the characteristic curve La, shown as a long and dash line in the relative level characteristics of FIG. 10; the level difference applied by the right-side level-difference application circuit 21 is represented by the characteristic curve Lb, shown as a dash line in the relative level characteristics of FIG. 10. This FIG. 10 shows levels relative to the state in which the head rotation position is 0° (the forward direction).

The characteristic curves La and Lb are curves having completely opposite directions of increase and decrease with respect to the direction of rotation of the head of the listener M. That is, in the level-difference application circuit 22 the level changes of the characteristic curve La are applied, and in the level-difference application circuit 21 the level changes of the characteristic curve Lb are applied, so that sound volume changes similar to the case of listening to an actual sound source in the forward direction are applied to the headphone reproduction signals as well.

The above explanation has described a method of localizing an acoustic image in front of the listener M; by reversing the directions of change of the characteristic selected by the direction of rotation, however, an acoustic image can also be localized behind the listener M. Further, processing can also be performed for an arbitrary number of channels for a plurality of sound sources.

By means of this invention, detection signals from the angular velocity sensor 1 are acquired by the digital signal processing circuit 31 simultaneously with the input audio signals, so that signal processing of the detection signals of the angular velocity sensor 1 and signal processing of these audio signals can be performed within the same device, specifically, within the digital signal processing device 31, and communication between hardware components is rendered unnecessary. DC offsets and temperature drift occurring due to the angular velocity sensor can be eliminated within the same device, that is, the digital signal processing circuit 31, and accurate rotation angle calculations are possible.

In this example, part of the one-bit A/D converter 30 constituting the angular velocity sensor interface is incorporated within the digital signal processing circuit 31, so that detection signals from the angular velocity sensor 1 can be input from the one-bit input port of the digital signal processing circuit, and a high-precision angular velocity sensor interface can be realized which is inexpensive and has a simple configuration.

In the above-described example, detection signals from the angular velocity sensor 1 are acquired by a one-bit ΔΣ-type A/D converter, so that input can be performed from the one-bit input port of the digital signal processing circuit 31, ΔΣ conversion processing can be used to greatly improve the effective conversion precision, and an extremely precise angular velocity sensor interface can be realized. In the above-described example, a first order noise-shaping circuit is configured; of course this may be a secondary or higher-order noise-shaping circuit, and in addition to the configuration of the example described above in which there is negative feedback of the output of the quantizer 30*d* from the one-bit output port, a configuration may be employed in which there is negative feedback of the quantization error of the quantizer 30*d*, that is, of the difference signal between the input signal and the output signal of the quantizer 30*d*.

Figure 3:
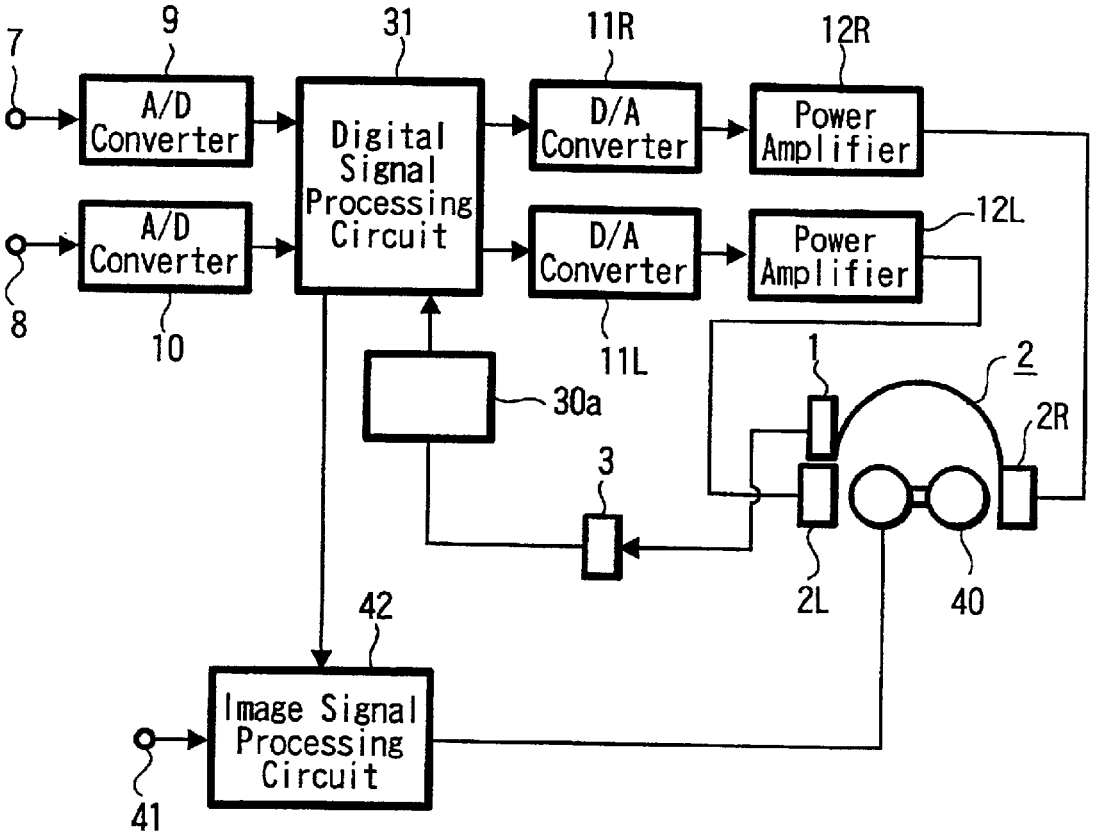
FIG. 3 is a schematic diagram showing an example of an embodiment of the signal processing device of this invention.
Figure 4:
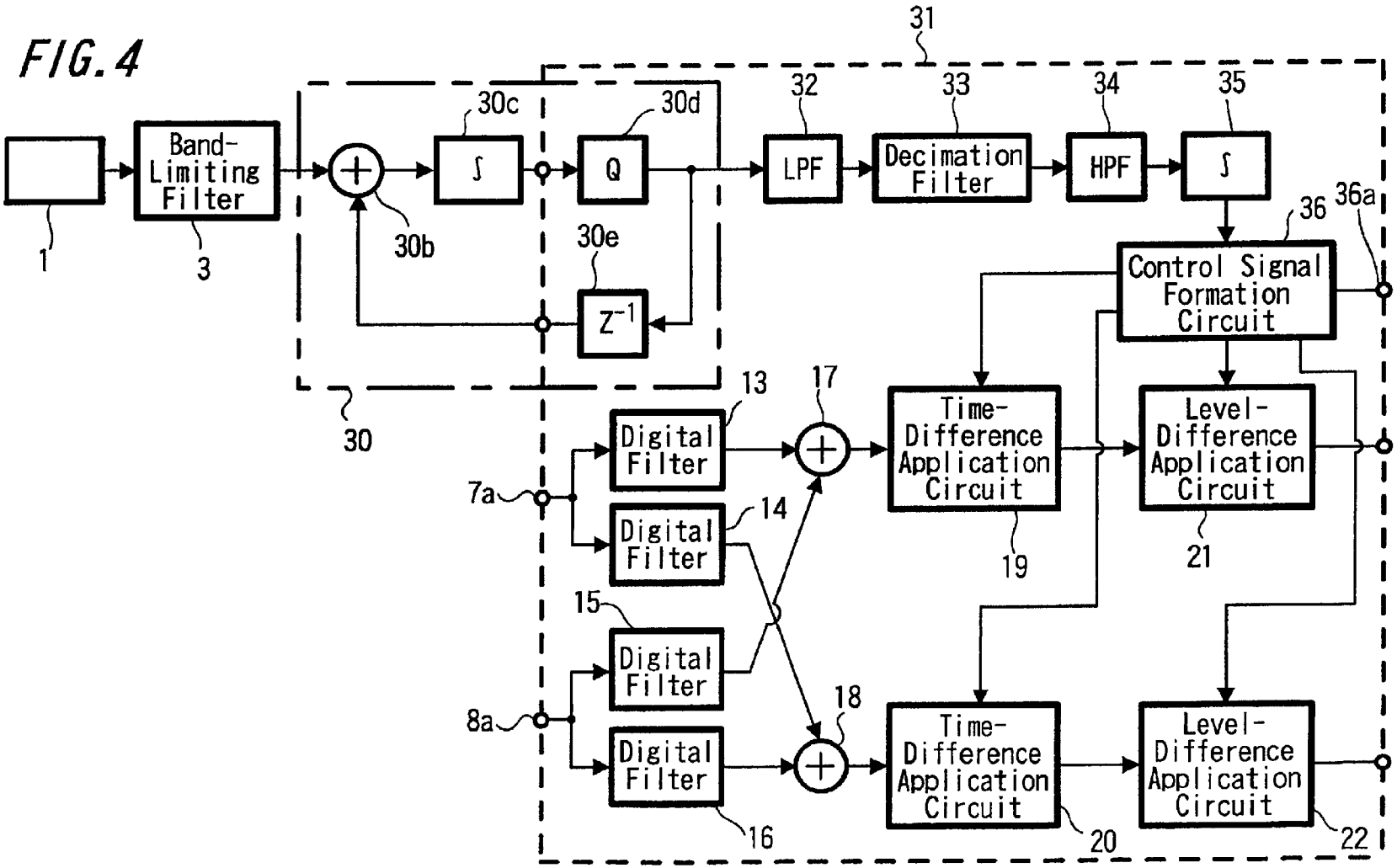
FIG. 4 is a functional block diagram showing an example of the digital signal processing circuit of the example of FIG. 3.

FIG. 3 and FIG. 4 show another example of an embodiment of this invention. In FIG. 3 and FIG. 4, parts which correspond to parts in FIG. 1 and FIG. 2 are assigned the same symbols, and a detailed explanation is omitted.

In the example of FIG. 3, an image display device 40, for example a head-mounted display, is mounted for both the eyes (or one eye) of the listener, and image signals from the image signal input terminal 41 are supplied to the image signal processing circuit 42; image signals subjected to signal processing by this image signal processing circuit 42 are then supplied to this image display device 40.

In the digital signal processing circuit 31 of this example, as shown in FIG. 4 the control signal formation circuit 36 is provided with an external output terminal 36*a*, and digital angle data obtained in this control signal formation circuit 36 is supplied to the image signal processing circuit 42. At this time, angle data obtained by conversion from angular velocity data is output.

In this case, angle data is supplied to the image signal processing circuit 42 either at the request of the image signal processing circuit 42, which is external equipment, or with a fixed period. In the former case, angle data may be requested, for example, from the control signal formation circuit 36 with timing synchronized with the image synchronization signal.

This image signal processing circuit 42 updates the display content or display position in the image display device 40, according to this angle data. The examples of FIG. 3 and FIG. 4 are configured similarly to the examples of FIG. 1 and FIG. 2.

In the examples of FIG. 3 and FIG. 4, when the display content of the image display device 40 mounted on both eyes (or only one eye) of the listener is changed according to movements of the listener, the interface for this can be realized simply by performing interface processing for the angular velocity sensor 1 mounted on the audio signal processing device, so that images and audio signals can be changed simultaneously using a simple configuration.

Figure 5:
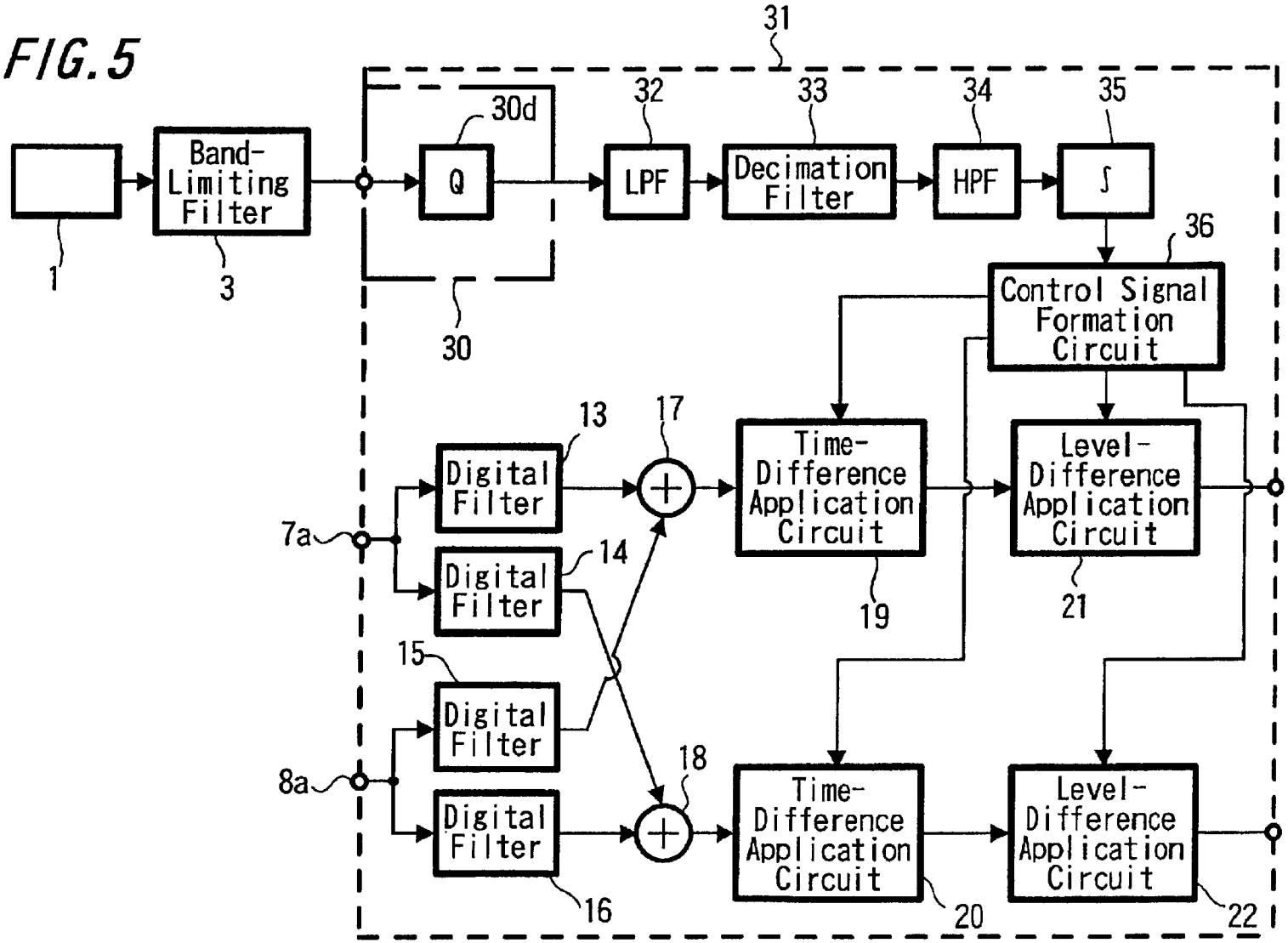
FIG. 5 is a functional block diagram showing another example of the digital signal processing circuit.

In the above-described example, a one-bit ΔΣ-type A/D converter is used as the one-bit A/D converter 30; in place of this, a quantizer 30*d* alone may be provided within the digital signal processing circuit 31 as the one-bit A/D converter as shown in FIG. 5, and the device configured from this. In this case, the entirety of the one-bit A/D converter 30 is formed within the digital signal processing circuit 31, and detection signals of the angular velocity sensor 1 are directly input to the quantizer 30*d*.

In the configuration of FIG. 5, the dynamic range, noise level, and other characteristics of the sensor interface unit are somewhat unfavorable compared with the case in which the above-described one-bit ΔΣ-type A/D converter is used; but the sensor output can be input directly to the digital signal processing circuit 31 via a band-limiting filter, so that still greater compactness is possible.

In the above-described example, the digital signal processing circuit 31 is explained in a hardware configuration; of course this may also be accomplished using a DSP (digital signal processor), microprocessor or similar device, equipped with a processing program to perform audio signal and sensor signal processing.

The above-described example is explained as a signal processing device which can be applied to out-of-head acoustic image localization headphones; of course the technology of this invention can also be applied to a signal processing device which provides audio signals which are, for example, reproduced by a plurality of speaker devices placed in front of the listener, to localize an acoustic image in places other than the speaker positions, for example, behind or to one side of the listener. In this case, the entirety of the one-bit A/D converter 30 is formed within the digital signal processing circuit 31.

In the above-described example, an angular velocity sensor was used as the sensor; but a geomagnetic direction sensor may be used instead. When such a geomagnetic direction sensor is used, rotation angles can be detected reliably using a simple configuration, and moreover absolute directions are detected, so that there is the advantage that no cumulative errors occur during integration processing of the angular velocity sensor signals in the above example.

Further, an inclination sensor may be used as this sensor. When using an inclination sensor, a simple configuration can be used to, for example, reliably detect the angle of inclination of the listener's head.

Further, a velocity sensor or acceleration sensor may be used as the sensor, displacement data calculated from A/D-converted velocity or acceleration data, and this calculated displacement data may be used. This displacement data may be output to external equipment as digital signals. When such a velocity sensor or acceleration sensor is used, changes in the listening position of the listener, for example when the listener moves forward or toward the right, can be detected.

In this case, external equipment processing (for example, image processing) can be performed simultaneously with, and in synchronization with, audio processing, and the sensor interface in the external equipment and velocity-displacement conversion processing can be simplified.

Further, a plurality of sensors may be provided, and processing of the detection signals of this plurality of sensors may be performed by the same digital signal processing circuit 31.

In this case, the detection signals of the plurality of sensors can be acquired by and processed within a single digital signal processing circuit 31, so that a single device can be used for detection of movements with more degrees of freedom.

This invention is not limited to the above examples, and of course various configurations can be adopted without deviating from the essence of this invention.

By means of this invention, the detection signals from a sensor can be acquired by a digital signal processing circuit simultaneously with input audio signals, so that signal processing of the sensor detection signals and signal processing of the audio signals can be realized within the same device, specifically, within a digital signal processing circuit; communication between hardware becomes unnecessary; the circuit scale can be reduced, and processing can be simultaneously performed to eliminate offsets; and accurate calculation of motions can be performed.

Further, the sensor interface can be realized by means of signal processing software, offsets can be eliminated through processing within the digital signal processing circuit, and there are no errors due to scattering in device characteristics.

By means of this invention, detection signals input as angular velocity data can be converted into angle data and output externally, so that external processing (for example, image processing) can be performed simultaneously with, and in synchronization with, audio processing, and the angular velocity sensor interface device and angle conversion processing in the external equipment can be simplified.

By means of this invention, when the display content in an image display device provided before one or both of the listener's eyes is changed according to movements of the listener, the interface for this can be provided through interface processing for a sensor mounted on the audio signal processing device, so that image and audio signals can be changed simultaneously using a simple configuration.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. An audio signal processing device for performing virtual acoustic image localization processing such that an acoustic image is localized at an arbitrary position in a vicinity of a listener, by reproducing by one of headphones and a plurality of speakers, output signals resulting from signal processing of input audio signals, the device comprising:

digital signal processing means for performing virtual acoustic image localization processing of said input audio signals;

a sensor for detecting a state of motion of the listener;

an A/D converter for converting into digital signals the analog detection signals from said sensor; and control means for performing control so as to change and output in realtime transmission characteristics of said digital signal processing means, according to output signals from said A/D converter, wherein at least part of said A/D converter is formed as part of said digital signal processing means wherein said A/D converter consists of a one-bit A/D converter which converts input analog signals into one-bit digital signals.

2. The audio signal processing device according to claim 1, wherein said A/D converter is $\Delta\Sigma$ type A/D converter.

3. The audio signal processing device according to claim 1, wherein said one-bit A/D converter consists of a quantizer, and analog detection signals from said sensor are directly input to this quantizer.

4. The audio signal processing device according to claim 1, wherein said sensor is a piezoelectric vibratory gyroscope which is an angular velocity sensor.

5. The audio signal processing device according to claim 1, wherein said sensor is a geomagnetic direction sensor.

6. The audio signal processing device according to claim 1, wherein said sensor is an inclination sensor.

7. The audio signal processing device according to claim 1, further comprising a plurality of A/D converters and a plurality of sensors and processing of detection signals fed to said plurality of A/D convertors from the plurality of sensors detecting the state of motion of said listener is performed by said digital signal processing means.

8. The audio signal processing device according to claim 1, wherein one of output signals of said A/D converter and control signals from said control means are output to external equipment.

9. The audio signal processing device according to claim 8, wherein said output to the external equipment is performed through requests from the external equipment.

10. The audio signal processing device according to claim 8, characterized in that said output to the external equipment is performed with a constant period.

11. The audio signal processing device according to claim 1, wherein output signals of said A/D converter can be output to external equipment as digital detection signals converted into a different unit system.

12. The audio signal processing device according to claim 11, wherein said sensor is an angular velocity sensor, and angle data is calculated from A/D converted angular velocity data, and the calculated digital angle data are output to the external equipment.

13. The audio signal processing device according to claim 11, wherein said sensor is one of a velocity sensor and an acceleration sensor, and wherein displacement data is calculated from A/D converted velocity or acceleration data and calculated digital displacement data are output to the external equipment.

14. An audio signal processing device that performs virtual acoustic image localization processing such that an acoustic image is localized at an arbitrary position in a vicinity of a listener by reproducing using one of headphones and a plurality of speakers, output signals resulting from signal processing of input audio signals, wherein said audio signal processing device comprises:

a one bit quantizer for converting analog detection signals from a sensor that detects a state of motion of said listener into digital signals, and control means for performing control so as to modify in realtime transmission characteristics of said audio signal processing device, according to output signals from said one bit quantizer.

15. The audio signal processing device according to claim 14, wherein one of output signals from said one bit quantizer and quantization error signals in said one bit quantizer are output to external equipment.

16. The audio signal processing device according to claim 14, wherein said sensor is a piezoelectric vibratory gyroscope which is an angular velocity sensor.

17. The audio signal processing device according to claim 14, wherein said sensor is a geomagnetic direction sensor.

18. The audio signal processing device according to claim 14, wherein said sensor is an inclination sensor.

19. The audio signal processing device according to claim 14, further comprising a plurality of said one bit quantizers and a plurality of sensors and processing of detection signals fed to said plurality of one-bit quantizers from said plurality of sensors which detect the state of motion of said listener is performed by said digital signal processing means.

20. The audio signal processing device according to claim 14, wherein one of output signals from said one bit quantizer and control signals from said control means are output to external equipment.

21. The audio signal processing device according to claim 20, wherein said output to the external equipment is performed through requests from the external equipment.

22. The audio signal processing device according to claim 20, wherein said output to the external equipment is performed with a constant period.

23. The audio signal processing device according to claim 14, wherein output signals from said one bit quantizer are output to external equipment as digital detection signals converted into a predetermined unit system.

24. The audio signal processing device according to claim 23, wherein said sensor is an angular velocity sensor, and angle data is calculated from A/D converted angular velocity data, and calculated digital angle data are output to the external equipment.

25. The audio signal processing device according to claim 23, wherein said sensor is one of a velocity sensor and an acceleration sensor, displacement data is calculated from one of A/D converted velocity and acceleration data, and calculated digital displacement data are output to the external equipment.

26. An interface circuit for supplying analog detection signals from a sensor as digital detection signals, comprising:

an A/D converter for converting said analog detection signals into digital signals;

computation means for converting said A/D converter output signals into detection data in a prescribed unit system; and memory means for storing detection data computed by said computation means, wherein detection data stored in said memory means are read by external equipment, wherein at least part of said A/D converter, said computation means and said memory means are formed as part of digital signal processing means which performs signal processing of and outputs input audio signal, wherein said A/D converter is a one-bit A/D converter.

27. The interface circuit according to claim 26, characterized in that said one-bit A/D converter is a $\Delta\Sigma$-type A/D converter.

28. The interface circuit according to claim 26, wherein said one-bit A/D converter consists of a quantizer, and analog detection signals from said sensor are directly input to this quantizer.

29. The interface circuit according to claim 26, wherein said sensor is an angular velocity sensor, and said computation means outputs the detection data as angle data.

30. A signal processing device, comprising:

an audio signal processing device for reproducing by one of headphones and a plurality of speakers output signals resulting from signal processing of input audio signals and for performing virtual acoustic image localization processing such that an acoustic image is localized at an arbitrary position in a vicinity of a listener, and an image display device for reproducing images before either one eye or both eyes of said listener;

said audio signal processing device including digital signal processing means for performing said virtual acoustic image localization processing of said input audio signals, an A/D converter for converting into digital signals analog detection signals from a sensor which detects a state of motion of said listener, and control means for performing control so as to change in realtime transmission characteristics of said digital signal processing means, according to output signals from said A/D converter and for performing control so as to update display content or display position in said image display device; and wherein at least part of said A/D converter is formed as part of said digital signal processing means.

* * * * *